US008277662B2

(12) United States Patent
Nakajima

(10) Patent No.: US 8,277,662 B2
(45) Date of Patent: Oct. 2, 2012

(54) STEAM BOILER APPARATUS AND OPERATING METHOD THEREFOR

(75) Inventor: Junichi Nakajima, Matsuyama (JP)

(73) Assignee: Miura Co., Ltd., Matsuyama-shi (JP)

( * ) Notice: Subject to any disclaimer, the term of this patent is extended or adjusted under 35 U.S.C. 154(b) by 455 days.

(21) Appl. No.: 12/730,736

(22) Filed: Mar. 24, 2010

(65) Prior Publication Data

US 2010/0243569 A1 Sep. 30, 2010

(30) Foreign Application Priority Data

Mar. 25, 2009 (JP) ..... 2009-075282

(51) Int. Cl.
*B01D 39/00* (2006.01)

(52) U.S. Cl. ..... 210/664; 210/670; 210/687; 210/750; 210/175; 210/188; 210/194; 210/198.1

(58) Field of Classification Search ..... 210/664, 210/670, 687, 750, 175, 188, 194, 198.1
See application file for complete search history.

(56) References Cited

U.S. PATENT DOCUMENTS

| | | | | |
|---|---|---|---|---|
| 2,330,865 | A * | 10/1943 | Butzler | 423/158 |
| 2,807,582 | A * | 9/1957 | Applebaum | 210/664 |
| 4,235,715 | A * | 11/1980 | Wiegert | 210/670 |
| 6,537,456 | B2 | 3/2003 | Mukhopadhyay | |
| 2004/0079088 | A1 * | 4/2004 | Hayakawa et al. | 60/784 |
| 2008/0163832 | A1 * | 7/2008 | Kume | 122/235.11 |
| 2008/0257831 | A1 * | 10/2008 | Nakajima et al. | 210/749 |

FOREIGN PATENT DOCUMENTS

| | | |
|---|---|---|
| JP | 59032801 | 2/1984 |
| JP | 62034606 | 2/1987 |
| JP | 7229603 | 8/1995 |
| JP | 2004293922 | 10/2004 |
| JP | 2006274427 | 10/2006 |
| JP | 2006275410 | 10/2006 |

* cited by examiner

*Primary Examiner* — Chester Barry
(74) *Attorney, Agent, or Firm* — Fox Rothschild LLP

(57) ABSTRACT

It is intended to effectively suppress corrosion of a feed-water supply pipe in a preheater, by means of recirculation of boiler water to feed-water to be supplied to a steam boiler, even if a concentration of an alkaline component of the feed-water is relatively high. An alkali metal hydroxide is added from an agent-adding unit (14) to feed-water after removing therefrom a water hardness component in a water-softener unit (15) using a cation exchange resin and then removing therefrom dissolved gas in a degasifier unit (16). Then, the feed-water is supplied to a steam boiler 20 via a feed-water supply line 13 while being heated by a preheater (41). A part of boiler water having a pH value increased along with an increase in concentration of the alkali metal hydroxide resulting from enrichment thereof in the steam boiler (20) is mixed with the feed-water via a recirculation line (38). An alkaline component of the feed-water in the feed-water supply line (13) reacts with hydrogen ions from the cation exchange resin to form a carbonic acid, so that a concentration of the alkaline component is reduced. Thus, when the boiler water is mixed with the feed-water, a pH of the feed-water is increased without being influenced by a buffering ability of the alkaline component, to suppress corrosion of the feed-water supply line (13).

10 Claims, 2 Drawing Sheets

STEAM BOILER APPARATUS AND OPERATING METHOD THEREFOR

BACKGROUND OF THE INVENTION

1. Field of the Invention

The present invention relates to a steam boiler apparatus, and more particularly to a steam boiler apparatus designed to supply feed-water for use as boiler water, from a feed-water supply line made of metal, and heat the boiler water in a steam boiler to generate steam.

2. Description of the Background Art

A steam boiler apparatus is equipped with a steam boiler and a feed-water supply system, and designed to supply feed-water for use as boiler water, from the feed-water supply system, and heat the boiler water in the steam boiler to generate steam. In some cases, the steam boiler apparatus is provided with a preheater for the feed-water, in order to suppress energy consumption due to heating of the boiler water in the steam boiler. The preheater is operable to heat a feed-water supply pipe of the feed-water supply system by use of exhaust heat from the steam boiler to thereby preliminarily heat feed-water to be supplied to the steam boiler.

In the above steam boiler apparatus, each of the feed-water supply pipe and a heat transfer tube for heating the boiler water in the steam boiler is made of metal, which means that each of the feed-water supply pipe and the heat transfer tube is placed under conditions where corrosion is likely to develop due to influence of the feed-water or the boiler water. Particularly, the feed-water supply pipe is always in contact with the feed-water, so that corrosion is likely to develop in a portion thereof to be heated by the preheater.

Typically, a water source of feed-water for the steam boiler apparatus is tap water or groundwater which contains an alkaline component (hydrogen carbonate and carbonate) as a natural component. Therefore, in the steam boiler supplied with such feed-water, the alkaline component is thermally decomposed to form a hydroxide, so that a pH value of boiler water can be increased to suppress corrosion of the heat transfer tube. However, in the feed-water supply pipe, even if the feet-water is subjected to heating by the preheater, a temperature of the feed-water is increased up to only about 120° C. at the highest. Thus, it is difficult to promote thermal decomposition of the alkaline component, i.e., to sufficiently increase a pH value of the feed-water as in the boiler water, so that the feed-water supply pipe is more likely to suffer development of corrosion than the heat transfer tube.

In view of this, JP 2006-275410A (hereinafter referred to as "Patent Document 1") proposes a technique of, in a feed-water supply system, allowing a part of boiler water having a pH value increased based on formation of a hydroxide to be returned or recirculated to an upstream side of a preheater and mixed with feed-water. In this technique, the boiler water is mixed with feed-water to increase a pH value of the feed-water, so that the feed-water becomes less likely to cause corrosion of a feed-water supply pipe in the preheater.

However, a change in pH value of the feed-water based on the mixing of the boiler water with the feed-water is influenced by a concentration of the alkaline component of the feed-water. Specifically, in cases where the alkaline component concentration is relatively low, the pH value of the feed-water is easily increased by mixing the boiler water with the feed-water. Conversely, in cases where the alkaline component concentration is relatively high, even if the boiler water having a high pH value is mixed with the feed-water, the pH value of the feed-water often shows only a slight increase, due to a buffering ability of the alkaline component. The alkaline component concentration of the feed-water varies depending on regionality of tap water or groundwater for use as a water source, and has an extremely high value in some cases. Thus, in a region where it is necessary to use such a water source as feed-water, it is difficult to suppress corrosion of a feed-water supply pipe in a preheater by the technique disclosed in the Patent Document 1.

SUMMARY OF THE INVENTION

In view of the above circumstances, it is an object of the present invention to effectively suppress corrosion of a feed-water supply pipe in a preheater, by means of recirculation of boiler water to feed-water to be supplied to a steam boiler, even if a concentration of an alkaline component of the feed-water is relatively high.

In order to achieve the object, the present invention provides a steam boiler apparatus which comprises a steam boiler adapted to heat boiler water to generate steam, a feed-water supply system having a feed-water supply line made of metal and adapted to supply feed-water for use as the boiler water, to the steam boiler therethrough, and a preheater adapted to heat the feed-water supply line by exhaust heat from the steam boiler, to heat the feed-water. In the steam boiler apparatus, the feed-water supply system includes: a water-softener unit adapted to treat the feed-water using a cation exchange resin capable of trapping a water hardness component contained in the feed-water while releasing hydrogen ions into the feed-water, to remove the hardness component from the feed-water; a degasifier unit adapted to remove dissolved gas contained in the feed-water after removing therefrom the water hardness component in the water-softener unit; an agent-adding unit adapted to add an agent containing an alkali metal hydroxide, into the feed-water after removing therefrom the dissolved gas in the degasifier unit and before being heated by the preheater, to neutralize the hydrogen ions from the cation exchange resin; and a recirculation device adapted to recirculate a part of the boiler water from the steam boiler to the feed-water after removing therefrom the dissolved gas in the degasifier unit and before being heated by the preheater, and mix the recirculated boiler water with the feed-water.

In the steam boiler apparatus of the present invention, feed-water from the feed-water supply system is supplied to the steam boiler. Then, the steam boiler heats the feed-water as boiler water to generate steam. In this process, during the course of supplying the feed-water from the feed-water supply system, the water hardness component causing scale formation is trapped and removed by the cation exchange resin in the water-softener unit, and then the dissolved gas such as dissolved oxygen causing corrosion of the steam boiler is removed in the degasifier unit. Then, the feed-water after removing therefrom the dissolved oxygen and adding thereinto the agent from the agent-adding unit is heated in the preheater by exhaust heat of the steam boiler, and supplied to the steam boiler, through the feed-water supply line made of metal. In the steam boiler, the boiler water is enriched along with the generation of steam, so that a concentration of the alkali metal hydroxide contained in the agent added to the feed-water becomes higher to increase a pH value of the boiler water. The increase in pH value of the boiler water makes it possible to suppress development of corrosion in the steam boiler.

During an operation of the above steam boiler apparatus, the cation exchange resin releases the hydrogen ions through substitution with the water hardness component and sodium ions in the feed-water. Then, the hydrogen ions react with an alkaline component in the feed-water to form a carbonic acid. Consequently, the feed-water after passing through the water-softener unit is placed in a state where a concentration of the alkaline component is lowered, and a carbonic acid is contained therein. Although the carbonic acid contained in the feed-water is likely to cause corrosion of the feed-water supply line and the steam boiler in the form of dissolved carbonic acid gas, it will be removed in the degasifier unit together with the dissolved oxygen. Then, the hydrogen ions remaining in the feed-water after removing therefrom the dissolved gas, primarily, the dissolved oxygen and the dissolved carbonic acid gas, are neutralized by the alkali metal hydroxide of the agent added from the agent-adding unit, and further a part of the high pH boiler water recirculated from the steam boiler is mixed with the feed-water. Then, the feed-water is subjected to heating by the preheater, and supplied to the steam boiler.

The feed-water after mixing therewith the high pH boiler water is placed in a state where a concentration of the alkaline component is lowered, and the carbonic acid is removed therefrom. Thus, the feed-water is less influenced by a buffering ability of the alkaline component and the carbonic acid, and the remaining hydrogen ions are neutralized by the alkali metal hydroxide of the agent, so that a pH value of the feed-water is effectively increased by the boiler water mixed therewith. Thus, even if the feed-water supply line is heated in the preheater, the development of corrosion in the feed-water supply line due to the feed-water can be suppressed.

In the steam boiler apparatus of the present invention, the feed-water supply system may further include a regenerating unit for supplying an organic acid to the water-softener unit to regenerate the cation exchange resin.

The present invention also provides a method of operating a steam boiler apparatus designed to supply feed-water for use as boiler water, from a feed-water supply line made of metal, and heat the boiler water in a steam boiler to generate steam. The method comprises the steps of: removing a water hardness component from the feed-water by a water-softener unit using a cation exchange resin capable of trapping the water hardness component contained in the feed-water while releasing hydrogen ions into the feed-water; removing dissolved gas contained in the feed-water after removing therefrom the water hardness component; heating the feed-water after removing therefrom the dissolved gas, by exhaust heat from the steam boiler; adding an agent containing an alkali metal hydroxide, into the feed-water after removing therefrom the dissolved gas and before being heated by the exhaust gas, to neutralize the hydrogen ions from the cation exchange resin; and recirculating a part of the boiler water from the steam boiler to the feed-water after removing therefrom the dissolved gas and before being heated by the exhaust heat, and mixing the recirculated boiler water with the feed-water.

In the operating method of the present invention, feed-water is supplied from the feed-water supply line made of metal to the steam boiler, and the steam boiler heats the feed-water as boiler water to generate steam. During the course of supplying the feed-water to the steam boiler, the water hardness component causing scale formation is trapped and removed by the cation exchange resin of the water-softener unit, and then the dissolved gas such as dissolved oxygen causing corrosion of the steam boiler is removed. Subsequently, the agent is added to the feed-water after removing therefrom the dissolved oxygen. Then, after heating the feed-water supply line by exhaust heat of the steam boiler to heat the feed water, the heated feed water is supplied to the steam boiler. In the steam boiler, the boiler water is enriched along with the generation of steam, so that a concentration of the alkali metal hydroxide contained in the agent added to the feed-water becomes higher to increase a pH value of the boiler water. The increase in pH value of the boiler water makes it possible to suppress development of corrosion in the steam boiler.

In the above operation method, the cation exchange resin releases the hydrogen ions through substitution with the water hardness component and sodium ions in the feed-water. Then, the hydrogen ions react with an alkaline component in the feed-water to form a carbonic acid. Consequently, the feed-water after removing therefrom the water hardness component in the water-softener unit is placed in a state where a concentration of the alkaline component is lowered, and a carbonic acid is contained therein. Although the carbonic acid contained in the feed-water is likely to cause corrosion of the feed-water supply line and the steam boiler in the form of dissolved carbonic acid gas, it will be removed in the step of removing the dissolved gas, together with the dissolved oxygen. Then, the agent containing an alkali metal hydroxide is added to the feed-water after removing therefrom the dissolved gas, primarily, dissolved oxygen and dissolved carbonic acid gas, before being heated by exhaust heat of the steam boiler, to thereby neutralize remaining hydrogen ions, and further a part of the high pH boiler water recirculated from the steam boiler is mixed with the feed-water to increase a pH value of the feed-water.

The feed-water after mixing therewith the high pH boiler water is placed in a state where a concentration of the alkaline component is lowered, and the carbonic acid is removed therefrom. Thus, the feed-water is less influenced by a buffering ability of the alkaline component and the carbonic acid, and the hydrogen ions are neutralized by the addition of the agent containing an alkali metal hydroxide, so that a pH value of the feed-water is effectively increased by the boiler water mixed therewith. Thus, even if the feed-water supply line is heated by exhaust heat of the steam boiler in order to heat the feed-water, the development of corrosion in the feed-water supply line due to influence of the feed-water can be suppressed.

The steam boiler apparatus operating method of the present invention may further comprise the step of supplying an organic acid to regenerate the cation exchange resin.

The agent for use in the steam boiler apparatus and the steam boiler apparatus operating method of the present invention to neutralize the hydrogen ions from the cation exchange resin may further contain a corrosion inhibitor for the steam boiler. For example, the corrosion inhibitor is at least one of a silicic acid and an alkali metal salt thereof.

As above, the steam boiler apparatus of the present invention makes it possible to effectively suppress corrosion of the feed-water supply line made of metal, in the preheater, by means of recirculation of boiler water to feed-water to be supplied to the steam boiler, even if a concentration of an alkaline component of the feed-water is relatively high.

The steam boiler apparatus operating method of the present invention also makes it possible to effectively suppress corrosion of the feed-water supply line made of metal, by means of recirculation of boiler water to feed-water to be supplied to the steam boiler, even if a concentration of an alkaline component of the feed-water is relatively high.

DESCRIPTION OF THE PREFERRED EMBODIMENTS

Figure 1:
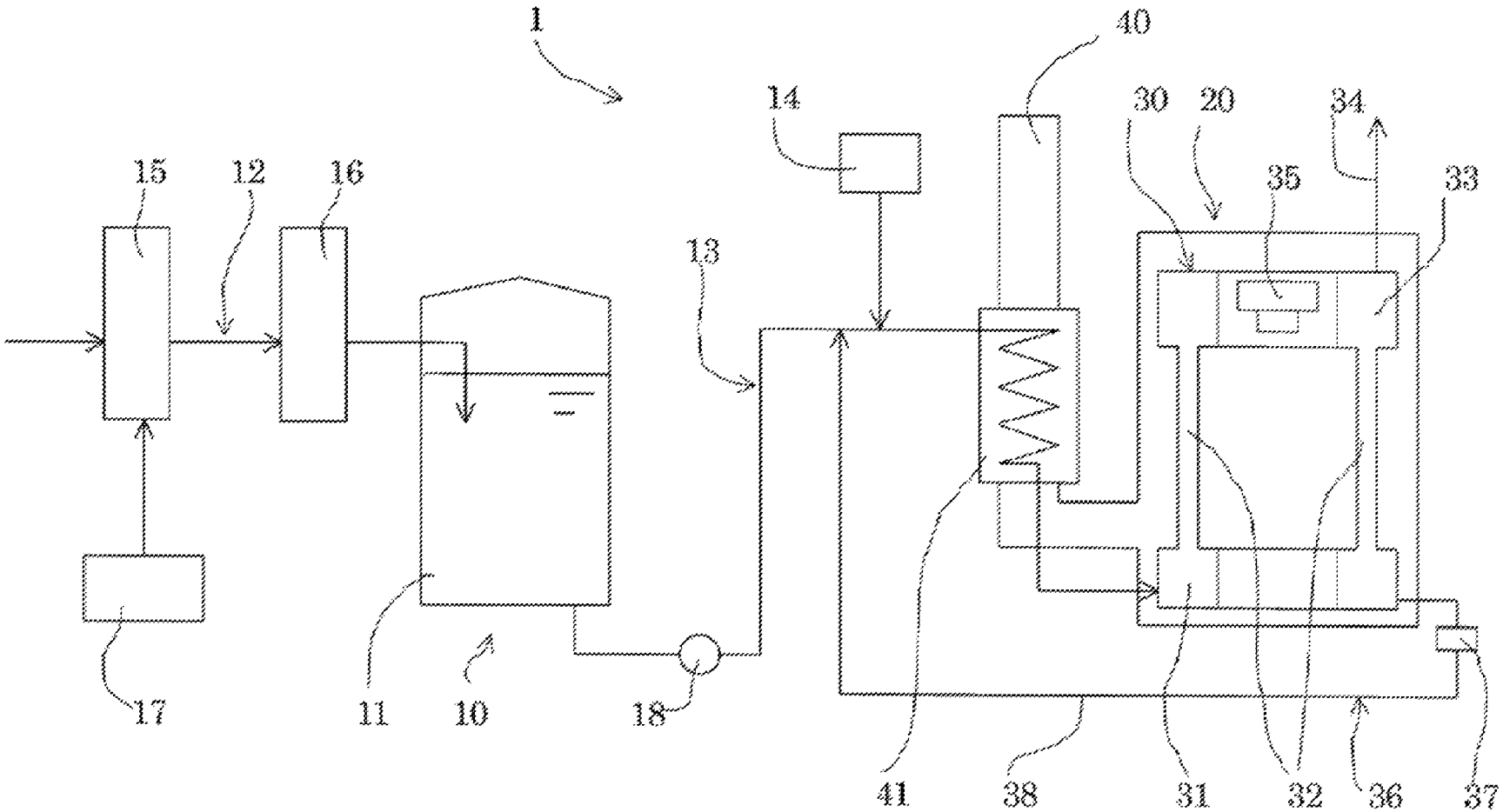
FIG. 1 is a schematic diagram showing a steam boiler apparatus according to one embodiment of the present invention.

With reference to FIG. 1, a steam boiler apparatus according to one embodiment of the present invention will be described. In FIG. 1, the steam boiler apparatus 1 is designed to supply steam to a load unit (not shown) which is steam-operated equipment, such as a heat exchanger, a steam jacketed kettle, a reboiler or an autoclave. The steam boiler apparatus 1 primarily comprises a feed-water supply system 10 and a steam boiler 20.

The feed-water supply system 10 is designed to adjust water quality of feed-water to be supplied to the steam boiler 20. The feed-water supply system 10 primarily includes a water storage tank 11 for storing therein the feed-water to be supplied to the steam boiler 20, a replenishment line 12 for replenishing feed-water in the water storage tank 11, a feed-water supply line 13 extending from the water storage tank 11 to the steam boiler 20, and an agent-adding unit 14. The water storage tank 11 is hermetically sealed in order to prevent oxygen and foreign substances in the atmosphere from being mixed into feed-water stored therein.

The replenishment line 12 extends from a raw water tank (not shown) which stores therein raw water supplied from a water source, such as tap water, industrial water or groundwater. Typically, the raw water to be used herein contains a water hardness component (calcium ion and magnesium ion), an alkaline component (hydrogen carbonate and carbonate), and a silica component (silicon dioxide, silicic acid and silicate), as natural components. The alkaline component consists primarily of carbonate, wherein hydrogen carbonate is also contained within a composition range thereof. The replenishment line 12 has a water softener unit 15 and a degasifier unit 16 in this order in a direction toward the water storage tank 11.

The water-softener unit 15 is designed to trap and remove the water hardness component and the sodium ions contained in feed-water supplied from the raw water tank, using a cation exchange resin, to allow the feed-water to become softened. The cation exchange resin to be used herein is a type capable of substituting hydrogen ions as counterions with the water hardness component and sodium ions contained in the feed-water to trap the water hardness component and the sodium ions while releasing the hydrogen ions into the feed-water. The water-softener unit 15 is provided with a regenerating unit 17 for regenerating the cation exchange resin. The regenerating unit 17 is operable to periodically supply an acid serving as a regenerant to the water-softener unit 15, wherein the acid is a type capable of removing the water hardness component and the sodium ions from the cation exchange resin to restore an ion exchange capacity of the cation exchange resin. The water hardness component and the sodium ions removed from the cation exchange resin by the acid from the regenerating unit 17 will be discarded from the water-softener unit 15 together with an unreacted part of the acid.

The acid to be supplied from the regenerating unit 17 may be an inorganic acid, such as hydrochloric acid or sulfuric acid, or may be an organic acid, such as citric acid or succinic acid. However, the hydrochloric acid or the sulfuric acid requires caution and skill in handling, because it falls under the category of deleterious substance. Moreover, the sulfuric acid is likely to react with calcium ions in the cation exchange resin during the regeneration to form hardly-soluble calcium sulfate. Therefore, it is preferable to use an organic acid, particularly, a citric acid, as the acid.

The degasifier unit 16 is designed to remove dissolved gas contained in the feed-water after removing therefrom the water hardness component in the water-softener unit 15. For example, the degasifier unit 16 may be one of various conventional types, such as a membrane degassing type adapted to allow feed-water to pass through a gas separation membrane so as to remove dissolved gas therefrom (e.g., a type adapted to allow feed-water to pass through a hollow fiber-shaped gas separation membrane, while reducing a pressure outside of the gas separation membrane, so as to remove dissolved gas therefrom), a vacuum degassing type adapted to spray feed-water under a reduced pressure environment so as to remove dissolved gas therefrom, and a thermal degassing type adapted to allow feed-water to pass through an internal passage while heating the feed-water, so as to remove dissolved gas therefrom. In the feed-water after being subjected to the treatment by the water-softener unit 15, a pH value is reduced due to an increase in hydrogen-ion concentration. Thus, if the membrane degassing type is used as the degasifier unit 16, such feed-water is likely to cause degradation of the gas separation membrane, resulting in deterioration of the dissolved-gas removal ability within a short period of time. Therefore, it is preferable to use the vacuum degassing type or the thermal degassing type as the degasifier unit 16.

The feed-water supply line 13 is designed to supply feed-water stored in the water storage tank 11, to the steam boiler 20 therethrough, and provided with a pump 18 for sending the feed-water stored in the water storage tank 11.

The agent-adding unit 14 is designed to add an agent to feed-water flowing through the feed-water supply line 13. The agent to be added is a type which has a capability to neutralize hydrogen ions remaining in feed-water after being released from the cation exchange resin, and contains a hydroxide which is low in buffering ability as an impediment to allowing a pH value of feed-water to be increased when an after-mentioned high pH boiler water is mixed with the feed-water, specifically, an alkali metal hydroxide, such as sodium hydroxide or potassium hydroxide. Typically, the agent is in the form of an aqueous solution.

The steam boiler 20 is a once-through boiler which primarily comprises a boiler body 30 and a gas duct 40. The boiler body 30 primarily includes an annular-shaped storage section 31 capable of storing therein feed-water supplied from the feed-water supply line 13 as boiler water, a large number of heat transfer tubes 32 each standing upright from the storage section 31 (only two of the heat transfer tubes 32 are illustrated in FIG. 1), an annular-shaped header 33 provided at respective upper ends of the heat transfer tubes 32, a steam supply line 34 extending from the header 33 to a load unit (not shown), and a combustion unit 35 such as a burner, and a recirculation device 36 extending from the storage section 31. The combustion unit 35 is operable to emit combustion gas from the side of the header 33 toward the storage section 31 to heat the heat transfer tubes 32. The recirculation device 36 has a recirculation line 38 provided with an on-off valve 37. The recirculation line 38 is connected to the feed-water supply line 13 at a position upstream of the agent-adding unit 14, and adapted, when the on-off valve 37 is opened, to allow a part of boiler water to be recirculated from the storage section 31 to the feed-water supply line 13 therethrough.

The gas duct 40 is designed to discharge high-temperature exhaust gas originating from the combustion gas emitted from the combustion unit 35, and provided with a preheater 41 for feed-water. Specifically, a portion of the feed-water supply line 13 formed in a spiral shape is arranged to pass through the preheater 41, so that the preheater 41 can heat the portion of the feed-water supply line 13 by heat of exhaust gas discharged through the gas duct 40.

In the above steam boiler apparatus 1, each of the feed-water supply line 13 and the heat transfer tubes 32 of the steam boiler 20 is made of a metal excellent in thermal conductivity. Typically, the metal forming each of the feed-water supply line 13 and the heat transfer tubes 32 is a non-passivatable metal. The non-passivatable metal means a metal which is not naturally passivated in a neutral aqueous solution. Typically, the non-passivatable metal is a metal except stainless steel, titanium, aluminum, chromium, nickel and zirconium. Specifically, the non-passivatable metal includes carbon steel, cast steel, copper and copper alloy. Although carbon steel is likely to be passivated in the presence of high-concentration chromium ions even in a neutral aqueous solution, the passivation is based on an effect of the chromium ions but it is not exactly natural passivation in a neutral aqueous solution. Thus, carbon steel belongs to the category of the non-passivatable metal. Further, although each of copper and copper alloy is generally considered as a metal insusceptible to corrosion due to moisture influence because of its relatively high position in the electrochemical series (electromotive force (emf) series), it is not naturally passivated in a neutral aqueous solution. Thus, copper and copper alloy also belong to the category of the non-passivatable metal.

A method of operating the above steam boiler apparatus 1 will be described below.

In an operation of the steam boiler apparatus 1, feed-water from the raw water tank is supplied to the water storage tank 11 via the replenishment line 12, and stored in the water storage tank 11. In this process, the feed-water from the raw water tank is firstly treated by the cation exchange resin in the water-softener unit 15, and formed as softened water which is the feed water after removing therefrom the water hardness component. Then, the dissolved gas such as dissolved oxygen in the softened water is removed in the degasifier unit 16. Thus, the feed-water after removing therefrom the water hardness component causing scale formation in the heat transfer tubes 32 of the steam boiler 20, and the dissolved oxygen causing corrosion, particularly, pitting corrosion, in the feed-water supply line 13, the heat transfer tubes 32 and others, is stored in the water storage tank 11.

In the water-softener unit 15, the cation exchange resin removes the water hardness component while releasing the hydrogen ions into the feed-water, i.e., softened water. The hydrogen ions react with an alkaline component contained in the feed-water to form a carbonic acid. Thus, the feed-water after removing therefrom the water hardness component in the water-softener unit 15 is placed in a state where a concentration of the alkaline component is reduced to a low value, and a carbonic acid is contained therein. The carbonic acid formed in the feed-water, i.e., dissolved carbonic acid gas, is removed in the degasifier unit 16 together with the dissolved oxygen.

Consequently, even in cases where the raw water contains a high concentration of alkaline component as a natural component, the feed-water containing the alkaline component having a concentration controlled to be at a low level will be stored in the water storage tank 11.

Upon activation of the pump 18 under a condition that the feed-water is stored in the water storage tank 11, the feed-water stored in the water storage tank 11 is supplied to the storage section 31 of the steam boiler 20 via the feed-water supply line 13. In some cases, a part of the hydrogen ions from the cation exchange resin remain in the feed-water, so that the feed-water in the water storage tank 11 has a low pH value which is likely to cause corrosion of the feed-water supply line 13 and the heat transfer tubes 32. For this reason, an agent containing an alkali metal hydroxide is added from the agent-adding unit 14 to the feed-water flowing through the feed-water supply line 13. The agent acts to neutralize the hydrogen ions remaining in the feed-water so as to adjust the pH value of the feed-water. In this case, an amount of the agent to be added from the agent-adding unit 14 is set to an excessive value greater than a value enough to neutralize the hydrogen ions. Thus, the pH value of the feed-water is largely increased, which makes it possible to more effectively suppress corrosion of the feed-water supply line 13 in the preheater 41 and the heat transfer tubes 32.

A portion of the feed-water supply line 13 is heated in the preheater 41 by heat of exhaust gas discharged from the boiler body 30 via the gas duct 40, to heat the feed-water to be supplied to the storage section 31 via the feed-water supply line 13. Thus, the feed-water heated to a high temperature will be supplied to the storage section 31.

The feed-water supplied to the storage section 31 is stored in the storage section 31 as boiler water. The boiler water is heated by combustion gas from the combustion unit 35 through the heat transfer tubes 32, so that it gradually turns into steam while flowing inside the respective heat transfer tubes 32 upwardly. The steam generated inside the heat transfer tubes 32 is collected to the header 33, and supplied to the load unit via the steam supply line 34. As mentioned above, the boiler water consists of the high-temperature feed-water heated in the preheater 41, so that a boiler-water heating load of the combustion unit 35 is reduced. This makes it possible to suppress energy consumption in the combustion unit 35 so as to economically operate the steam boiler 20.

In the storage section 31 of the steam boiler 20, the boiler water is enriched along with the generation of steam, so that a concentration of the alkali metal hydroxide contained in the agent added to the feed-water becomes higher to increase a pH value of the boiler water. Further, the feed-water contains a silica component having a metal-corrosion inhibiting action, as a natural component. Thus, based on the enrichment, a concentration of the silica component in the boiler water also becomes higher. As a consequence of these phenomena, the boiler water becomes less likely to cause corrosion of the heat transfer tubes 32.

In the above operation, it is preferable that a part of the boiler water is appropriately discharged from the storage section 31 while diluting the boiler water with the feed-water from the feed-water supply line 13, to maintain a pH of the boiler water in the range of 11 to 12 so as to effectively suppress corrosion of the heat transfer tubes 32. Further, the on-off value 37 is appropriately opened to allow a part of the boiler water having a pH value and an alkaline component concentration each increased in the storage section 31 to be recirculated to the feed-water supply line 13 via the recirculation line 38, and mixed with the feed-water. The feed-water flowing through the feed-water supply line 13 is controlled to have a low alkaline component concentration, so that the feed-water is less influenced by a buffering ability of the alkaline component, and a pH value of the feed-water is increased by the high pH boiler water mixed therewith. Thus, corrosion of the feed-water supply line 13 in the preheater 41 due to influence of the feed-water to be supplied to the storage section 31 becomes less likely to develop.

During the above operation of the steam boiler apparatus along with trapping of the water hardness component in the feed-water, the cation exchange resin of the water-softener unit 15 changes from H-type to other type (Ca-type or Mg-type), so that an ion exchange capacity thereof is lowered. Therefore, an acid serving as a regenerating agent is periodically supplied from the regenerating unit 17. The acid allows the trapped water hardness component to be removed so as to regenerate the cation exchange resin of the water-softener unit 15 to restore the ion exchange capacity. This makes it possible to operate the steam boiler apparatus 1 stably and continuously.

[Modification]

(1) In the above embodiment, the agent from the agent-adding unit 14 is added to the feed-water after mixing therewith the boiler water from the recirculation line 38, in the feed-water supply line 13. Alternatively, the agent from the agent-adding unit 14 may be added to the feed-water before mixing therewith the boiler water from the recirculation line 38.

(2) The agent to be added from the agent-adding unit 14 to the feed-water may contain a corrosion inhibitor for the feed-water supply line 13 and the heat transfer tubes 32, together with the alkali metal hydroxide capable of neutralizing hydrogen ions remaining in the feed-water. Particularly, in cases where feed-water is adjusted based on raw water having a high alkaline component concentration due to geographical factors, it is preferable to use a type containing the corrosion inhibitor, as the agent, because such raw water is highly likely to contain a low amount of a silica component capable of exerting a corrosion inhibiting action on the feed-water supply line 13 and the heat transfer tubes 32. For example, a usable corrosion inhibitor includes a silicic acid, a salt of silicic acid, a phosphoric acid, a salt of phosphoric acid, a citric acid, a salt of citric acid, a succinic acid, a salt of succinic acid, and tannin. Typically, each of the salts is an alkali metal salt. These corrosion inhibitors may be appropriately used in combination. Among them, a preferred corrosion inhibitor is a compound contained in raw water as a natural component, such as a silicic acid or an alkali metal salt thereof, because it is less likely to impose an environmental load when discharged as a part of boiler water. The silicic acid and the alkali metal salt thereof may be appropriately used in combination.

In addition to the corrosion inhibitor, the agent may contain a conventional cleaning agent for steam boilers, for example: a scale dispersant, such as an ethylenediamine tetraacetic acid, a salt of ethylenediamine tetraacetic acid, a polyacrylic acid or a salt of polyacrylic acid; or an oxygen scavenger, such as a sulfurous acid, a salt of sulfurous acid or sugars. Typically, each of the salts is an alkali metal salt.

Figure 2:
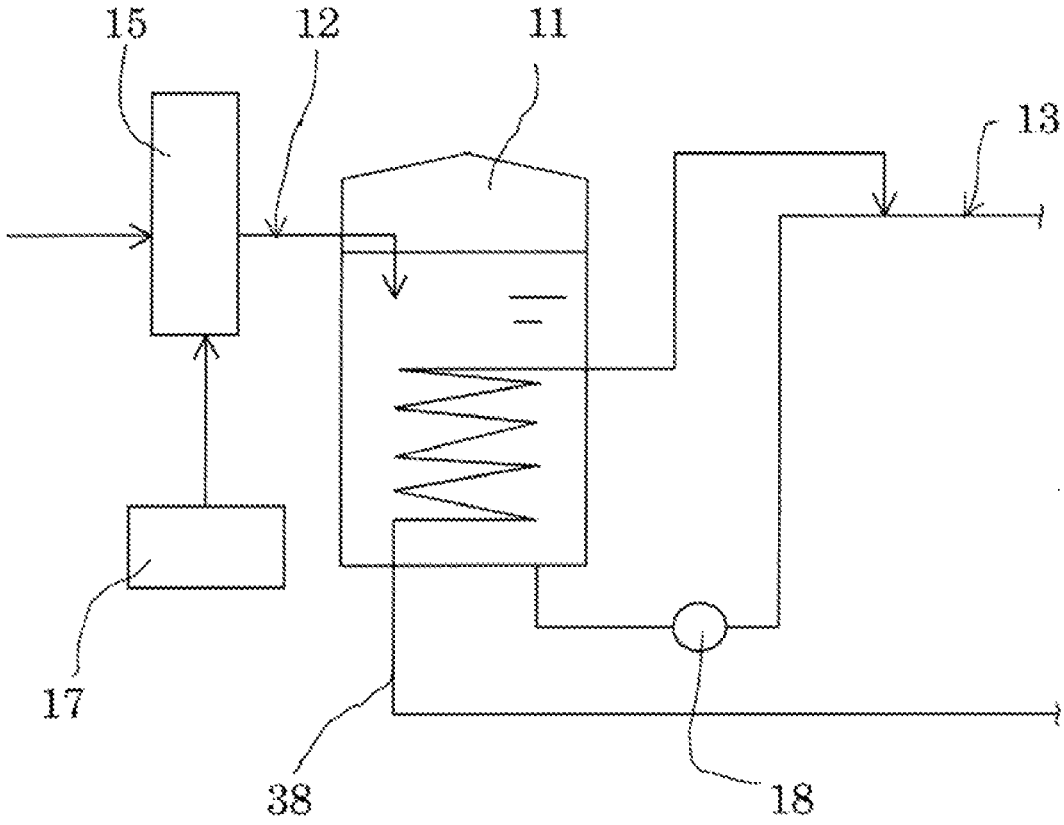
FIG. 2 is a fragmentary schematic diagram showing one example of modification of the steam boiler apparatus.

(3) The water storage tank 11 may be combined with the recirculation line 38 to additionally serve as a degasifier unit for removing dissolved gas contained in the feed-water. For example, as shown in FIG. 2, the degasifier unit 16 in the replenishment line 12 is omitted, and the water-softener unit 15 is directly connected to the water storage tank 11. Further, the recirculation line 38 is connected to the feed-water supply line 13 after passing through an inside of the water storage tank 11.

In this case, the feed-water stored in the water storage tank 11 can be heated by the high-temperature boiler water recirculated via the recirculation line 38, so that the water storage tank 11 can serve as a heated-type degasifier unit for removing dissolved gas contained in the feed-water.

(4) Although the above embodiment has been described based on one example where a once-through boiler is used as the steam boiler 20, the present invention can be implemented in a steam boiler apparatus using any type other than the once-through boiler as the steam boiler 20.

What is claimed is:

1. A steam boiler apparatus comprising:

a steam boiler adapted to heat boiler water to generate steam;

a feed-water supply system having a feed-water supply line made of metal and adapted to supply feed-water for use as the boiler water, to the steam boiler therethrough; and a preheater adapted to heat the feed-water supply line by exhaust heat from the steam boiler, to heat the feed-water, wherein the feed-water supply system includes:

a water-softener unit adapted to treat the feed-water using a cation exchange resin capable of trapping a water hardness component contained in the feed-water while releasing hydrogen ions into the feed-water, to remove the water hardness component from the feed-water;

a degasifier unit adapted to remove dissolved gas contained in the feed-water after removing therefrom the water hardness component in the water-softener unit;

an agent-adding unit adapted to add an agent containing an alkali metal hydroxide, into the feed-water after removing therefrom the dissolved gas in the degasifier unit and before being heated by the preheater, to neutralize the hydrogen ions from the cation exchange resin; and a recirculation device adapted to recirculate a part of the boiler water from the steam boiler to the feed-water after removing therefrom the dissolved gas in the degasifier unit and before being heated by the preheater, and mix the recirculated boiler water with the feed-water.

2. The steam boiler apparatus as defined in claim 1, wherein the feed-water supply system further includes a regenerating unit adapted to supply an organic acid to the water-softener unit to regenerate the cation exchange resin.

3. The steam boiler apparatus as defined in claim 1, wherein the agent further contains a corrosion inhibitor for the steam boiler.

4. The steam boiler apparatus as defined in claim 3, wherein the corrosion inhibitor is at least one of a silicic acid and an alkali metal salt thereof.

5. The steam boiler apparatus as defined in claim 2, wherein the agent further contains a corrosion inhibitor for the steam boiler.

6. A method of operating a steam boiler apparatus designed to supply feed-water for use as boiler water, from a feed-water supply line made of metal, and heat the boiler water in a steam boiler to generate steam, the method comprising the steps of:

removing a water hardness component from the feed-water by a water-softener unit using a cation exchange resin capable of trapping the water hardness component contained in the feed-water while releasing hydrogen ions into the feed-water;

removing dissolved gas contained in the feed-water after removing therefrom the water hardness component;

heating the feed-water after removing therefrom the dissolved gas, by exhaust heat from the steam boiler;

adding an agent containing an alkali metal hydroxide, into the feed-water after removing therefrom the dissolved gas and before being heated by the exhaust gas, to neutralize the hydrogen ions from the cation exchange resin; and recirculating a part of the boiler water from the steam boiler to the feed-water after removing therefrom the dissolved gas and before being heated by the exhaust heat, and mixing the recirculated boiler water with the feed-water.

7. The method as defined in claim 6, which further comprises the steps of supplying an organic acid to regenerate the cation exchange resin.

8. The method as defined in claim 6, wherein the agent further contains a corrosion inhibitor for the steam boiler.

9. The method as defined in claim 8, wherein the corrosion inhibitor is at least one of a silicic acid and an alkali metal salt thereof.

10. The method as defined in claim 7, wherein the agent further contains a corrosion inhibitor for the steam boiler.

* * * * *